United States Patent [19]

Gelsing

[11] 4,241,232

[45] Dec. 23, 1980

[54] WELDED INTEGRAL TUBE WALL FOR ELECTRIC STEEL-SMELTING FURNACE

[75] Inventor: Winfried Gelsing, Essen, Fed. Rep. of Germany

[73] Assignee: Oschatz GmbH, Essen, Fed. Rep. of Germany

[21] Appl. No.: 15,338

[22] Filed: Feb. 26, 1979

[30] Foreign Application Priority Data

Mar. 1, 1978 [DE] Fed. Rep. of Germany ..... 2808686

[51] Int. Cl.[3] ..... F27D 1/12

[52] U.S. Cl. ..... 13/32; 110/336; 432/233

[58] Field of Search ..... 13/32, 35; 432/233; 110/336

[56] References Cited

U.S. PATENT DOCUMENTS

| | | | |
|---|---|---|---|
| 3,850,146 | 11/1974 | Graham et al. | 110/336 |
| 4,058,668 | 11/1977 | Clites | 13/32 |
| 4,161,620 | 7/1979 | Nakamura | 13/32 |

*Primary Examiner*—Roy N. Envall, Jr.
*Attorney, Agent, or Firm*—Karl F. Ross

[57] ABSTRACT

A tube wall for forming the heating chamber of an electric steel-smelting furnace is comprised of a plurality of generally parallel tubes each closely juxtaposed with at least one adjacent tube of the plurality and forming therewith an outer groove open away from the chamber and an inner groove open toward the chamber. Welds extend the full length of and substantially fill at least the bases of the outer grooves and each form a gas-tight connection between the respective tubes. In addition tubular transverse reinforcing members are welded to the outside of the wall formed with these tubes, and a coolant is circulated through the reinforcing members through the tubes. Finally lining anchors in the form of hooks have inner ends conforming to the space between adjacent tubes and engage between these tubes to the weld securing them together. The wall is therefore formed simply by the tubes and the welds, and no further gas-tight wall need be provided.

10 Claims, 1 Drawing Figure

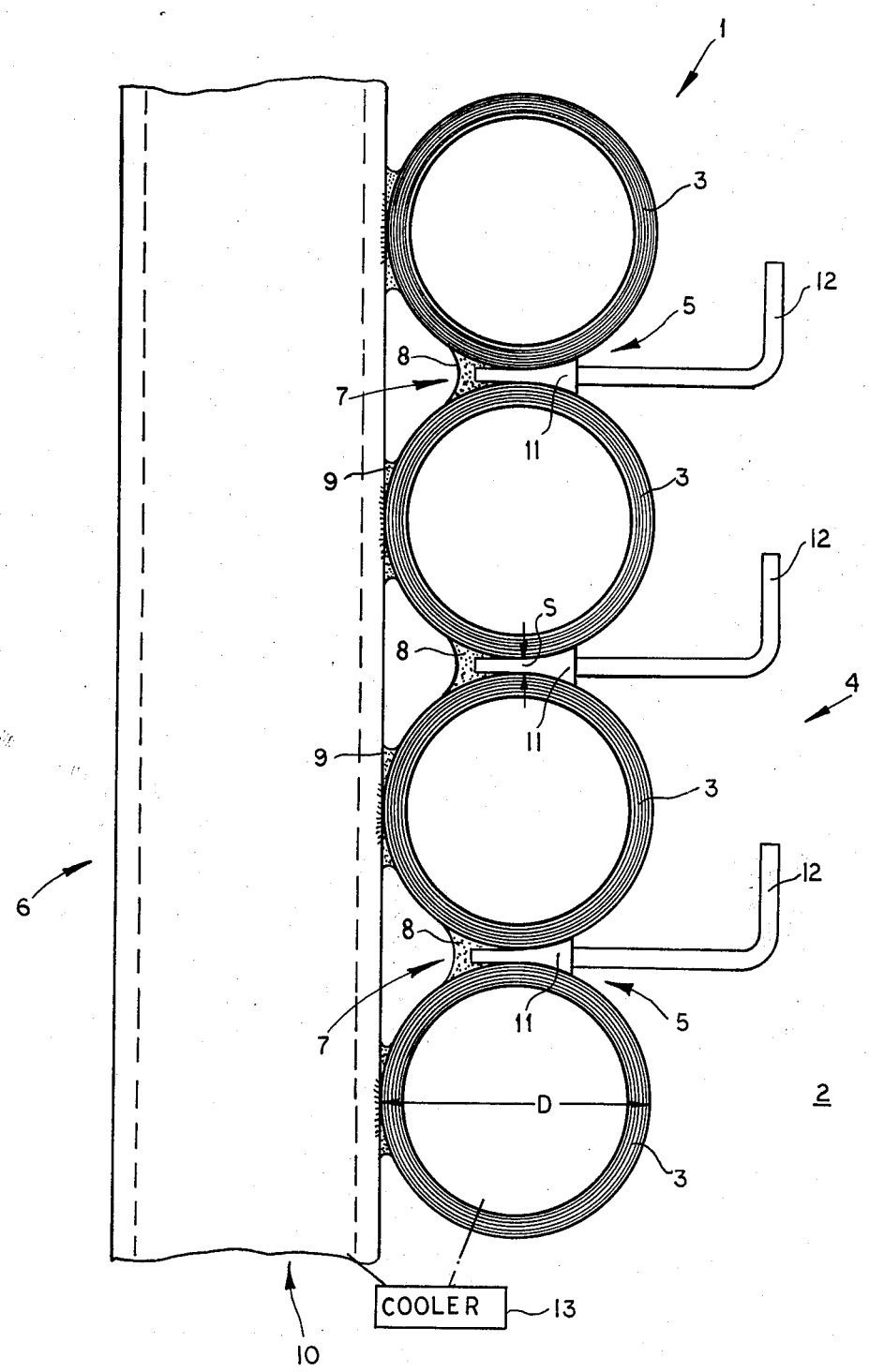
1
3
12
5
8
7
11
9
3
12
S
8
4
11
9
3
6
12
8
7
11
5
D
2
3
COOLER
13
10

WELDED INTEGRAL TUBE WALL FOR ELECTRIC STEEL-SMELTING FURNACE

FIELD OF THE INVENTION

The present invention relates to a wall for forming the heating chamber of a furnace. More particularly this invention concerns a so-called tube wall used in an electric steel-smelting furance.

BACKGROUND OF THE INVENTION

It is a standard practice to form the wall of a steel-smelting furnace of a plurality of generally parallel tubes. The ends of these tubes are connected together by means of 180° reverse bends and a coolant is pumped through them to prevent the tubes from heating so much that they soften.

In order to make the furnace wall gastight, it is standard practice to provide a second sheet-steel wall adjacent such a tube wall. The resultant structure is therefore both cooled and gastight.

A disadvantage of this type of arrangement is that the tubes are frequently damaged. This can happen during charging of the furnace with scrap. Making the tubes heavier to resist such damage merely increases their heat capacity and makes cooling them an even more expensive operation.

OBJECTS OF THE INVENTION

It is therefore an object of the present invention to provide an improved tube wall for a furnace.

Another object is to provide a tube wall for an electric steel-smelting furnace which overcomes the above-given disadvantages.

SUMMARY OF THE INVENTION

These objects are attained according to the instant invention by forming a tube wall in the manner generally described above, but without use of a second gastight sheet-steel wall. The use of this wall is eliminated by securing each of the tubes to its adjacent tube or tubes by means of a longitudinally extending weld. Each tube forms with at least one adjacent tube an inner groove opening toward the chamber and an outer groove opening away from the chamber. According to this invention these welds extend longitudinally and substantially fill at least the base of the outer grooves.

Withe the system according to the instant invention it is therefore possible to form an extremely rigid and gastight wall merely by welding together an array of parallel and normally coplanar tubes. The resultant structure is extremely rigid, even when relatively light-gauge tubing is used. In addition the expense of using a second gastight wall is completely avoided so that the structure can be produced at much lower costs than the hitherto used structures. The provision of the welds in the outer grooves eliminates the notch effect which would otherwise tend to allow separation of the tubes from each other.

In accordance with yet another feature of this invention reinforcing members are provided which are welded to all of the tubes of the array and extend generally perpendicular to them. These reinforcing members lie in the outside of the wall and are secured to each tube of the wall by welds. In accordance with this invention these reinforcing members can be of U-section and open toward the wall to form therewith a channel extending along the wall. It is also possible to use further tubes as these reinforcing members. In both cases a coolant is circulated through the reinforcing members as well as through the tubes, so that thermal expansion and contraction of the entire wall would be identical and stress at the joints between the cooled tubes and the reinforcing members would be avoided.

It is further possible in accordance with this invention to provide liner anchors in the form of L-hooks each having a bent-up inner end in the chamber and an outer end engaged between tubes of the wall. To this end each such outer end is shaped complementarily to the space between the tubes it is fitted between, and indeed extends all the way through to the weld in the outer groove between the two tubes it is fitted between. Thus the outer ends of these lining hooks are well secured and cooled. Slag or packed lining is supported on the inner ends of these anchors.

BRIEF DESCRIPTION OF THE DRAWING

The sole FIGURE of the drawing is a vertical section through a portion of a wall according to this invention, partly in diagrammatic form.

SPECIFIC DESCRIPTION

A tube wall 1 according to this invention comprises a plurality of identical cylindrical tubes 3 adapted to define a heating chamber 2 of an electric steel-smelting furnace. The ends of the tubes 3 are interconnected by reverse bends so that a cooler 13 can circulate a coolant such as water through them.

These tubes 2 define an inner area 4 and have inwardly open grooves 5 between adjacent tubes. Similarly outwardly open grooves 7 are directed toward the outside 6 of the wall 1. Deposit welds 8 extend the full length of the tubes 3 in the outer grooves 7 and completely fill same. Thus these welds 8 not only secure the tubes 3 rigidly together, but also form a gas-tight connection between adjacent tubes 3.

Furthermore according to this invention a reinforcing member 9 extending on the outside 6 perpendicular to the tubes 3 is secured by means of welds 9 to the tubes 3. The cooler 13 circulates water also through the interior of this tubular reinforcing member 10 so that thermal expansion and contraction is identical throughout the wall 1.

Finally anchors 12 for a slag or packed lining are provided in the chamber 2 on the inside 4 of the wall 1. These anchors 12 are constituted as hooks having inner ends 11 which are shaped to conform to the space between adjacent tubes 3 and which extend all the way into the welds 8 in the grooves 7. These inner ends are therefore outwardly tapered.

Each of the tubes 3 has a diameter D which is equal to at least ten times the spacing S between adjacent tubes in the plane of the wall 1.

I claim:

1. A wall for forming the heating chamber of a furnace, said wall comprising:

a plurality of generally parallel tubes each closely but spacedly juxtaposed with at least one adjacent tube of said plurality and forming therewith an outer groove open away from said chamber and an inner groove open toward said chamber;

lining anchors each having an inner end spaced toward said chamber from said tubes and an outer end wedged between two respective tubes and extending outwardly into the respective outer groove;

respective deposit welds extending the full length of and substantially filling at least the bases of said outer grooves and each forming a gastight connection between the respective tubes, said outer ends being embedded in said welds; and means for circulating a coolant through said tubes.

2. The wall defined in claim 1, further comprising means for circulating a coolant through said tubes.

3. The wall defined in claim 1, further comprising a structural member extending transverse to and contacting said tubes over said outer grooves, and welds securing said structural member to said tubes.

4. The wall defined in claim 3 wherein said structural member is a reinforcing tube, said wall further comprising means for circulating a coolant through all of said tubes.

5. The wall defined in claim 1, further comprising lining anchors each having an inner end spaced toward said chamber from said tubes and an outer end engaged between two respective tubes.

6. The wall defined in claim 5 wherein said inner ends are engaged in said welds.

7. The wall defined in claim 4 wherein said inner ends are complementarily shaped to said inner grooves.

8. The wall defined in claim 1 wherein said furnace is an electric steel-smelting furnace.

9. The wall defined in claim 1 wherein said tubes are spaced slightly apart and said welds fill the spaces between said tubes.

10. The wall defined in claim 9 wherein said spaces are equal to at most one-tenth of the diameters of said tubes.

* * * * *